US007284613B2

(12) United States Patent
Billingham et al.

(10) Patent No.: US 7,284,613 B2
(45) Date of Patent: Oct. 23, 2007

(54) METHOD AND APPARATUS FOR ASSEMBLING STACKABLE GUN SYSTEM INSIDE A WELL BORE

(75) Inventors: Matthew Billingham, Houston, TX (US); Robert Algie, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/347,035

(22) Filed: Feb. 3, 2006

(65) Prior Publication Data

US 2007/0181303 A1 Aug. 9, 2007

(51) Int. Cl.
*E21B 43/11* (2006.01)

(52) U.S. Cl. ..... 166/297; 166/55; 166/55.2; 166/242.6

(58) Field of Classification Search ..... 166/297, 166/55, 55.2, 242.6; 175/4.6
See application file for complete search history.

(56) References Cited

U.S. PATENT DOCUMENTS 4,612,992 A 9/1986 Vann et al.
5,366,014 A * 11/1994 George ..... 166/297
5,669,448 A * 9/1997 Minthorn et al. ..... 166/308.1
5,848,646 A 12/1998 Huber et al.
6,059,042 A 5/2000 Huber et al.
6,658,981 B2 12/2003 Rochen et al.
6,966,378 B2 11/2005 Hromas et al.
2002/0100360 A1 8/2002 Rochen et al.
2003/0196806 A1 10/2003 Hromas et al.
2005/0217853 A1 10/2005 Hayes et al.
2005/0217854 A1 10/2005 Hayes et al.
2005/0284635 A1 12/2005 Neves et al.

* cited by examiner

*Primary Examiner*—David Bagnell
*Assistant Examiner*—Giovanna M Collins
(74) *Attorney, Agent, or Firm*—Rodney Warfford; David Cate; Jaime Cartauo

(57) ABSTRACT

A method for assembling a stackable perforating gun system inside a well bore is provided that includes attaching a first gun section of the stackable perforating gun system to a tracking assembly, and transporting the first gun section within the well bore using the tracking assembly. The method also includes disengaging the first gun section from the tracking assembly; retrieving the tracking assembly to the surface; attaching a second gun section of the stackable perforating gun system to the tracking assembly; transporting the second gun section within the well bore using the tracking assembly; and coupling the second gun section with the first gun section using the tracking assembly.

9 Claims, 3 Drawing Sheets

METHOD AND APPARATUS FOR ASSEMBLING STACKABLE GUN SYSTEM INSIDE A WELL BORE

BACKGROUND

1. Field of the Invention

Implementations of various technologies described herein generally relate to a stackable gun system for use in a downhole environment, and more particularly, to deploying and retrieving sections of a stackable gun system through a well bore.

2. Description of the Related Art

The following descriptions and examples are not admitted to be prior art by virtue of their inclusion within this section.

It is often desirable to perforate zones of interest in a subterranean well with very long perforating gun strings to maximize production of well fluids, such as hydrocarbons. This may be particularly true in horizontal or highly deviated wells. Perforating gun strings may range in length from a few hundred feet to several thousand feet.

If the perforating gun string is too long to be deployed or retrieved through the well bore in one run, the perforating gun string may be left in the well bore. Leaving the perforating gun string in the well bore may require the creation of a rat hole that is sized to receive the perforating gun string after perforation. This problem may be further exacerbated in highly deviated or horizontal wells. Further, once dropped, the perforating gun string may hinder access to the perforated zone.

Alternatively, the perforating gun string may be removed after killing the well following perforation. However, killing the well may have adverse affects on the flow performance of the well once the well is resuscitated into production.

SUMMARY

In one embodiment, the present invention is a method for assembling a stackable perforating gun system inside a well bore that includes attaching a first gun section of the stackable perforating gun system to a tracking assembly, and transporting the first gun section within the well bore using the tracking assembly. The method also includes disengaging the first gun section from the tracking assembly; retrieving the tracking assembly to the surface; attaching a second gun section of the stackable perforating gun system to the tracking assembly; transporting the second gun section within the well bore using the tracking assembly; and coupling the second gun section with the first gun section using the tracking assembly.

In another embodiment, the present invention is a method for assembling a stackable perforating gun system inside a well bore that includes connecting a tracking assembly to a wireline, wherein the tracking assembly comprises a tractor, an anchor and a linear actuator; attaching a first gun section of the stackable perforating gun system to a tracking assembly, and activating the tracking assembly tractor to transport the first gun section within the well bore. The method also includes disengaging the first gun section from the tracking assembly; retrieving the tracking assembly to the surface; attaching a second gun section of the stackable perforating gun system to the tracking assembly; activating the tracking assembly tractor to transport the second gun section within the well bore; and activating the linear actuator to couple the second gun section with the first gun section.

The claimed subject matter is not limited to implementations that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

It is to be noted that the appended drawings illustrate only typical embodiments of this invention and are therefore not to be considered limiting of its scope, for the invention may admit to other equally effective embodiments.

DETAILED DESCRIPTION

As used here, the terms "up" and "down"; "upper" and "lower"; "upwardly" and "downwardly"; "upstream" and "downstream"; "above" and "below" and other like terms indicating relative positions above or below a given point or element may be used in connection with implementations of various technologies described herein. However, when applied to equipment and methods for use in wells that are deviated or horizontal, such terms may refer to a left to right, right to left, or other relationship as appropriate.

Figure 1:
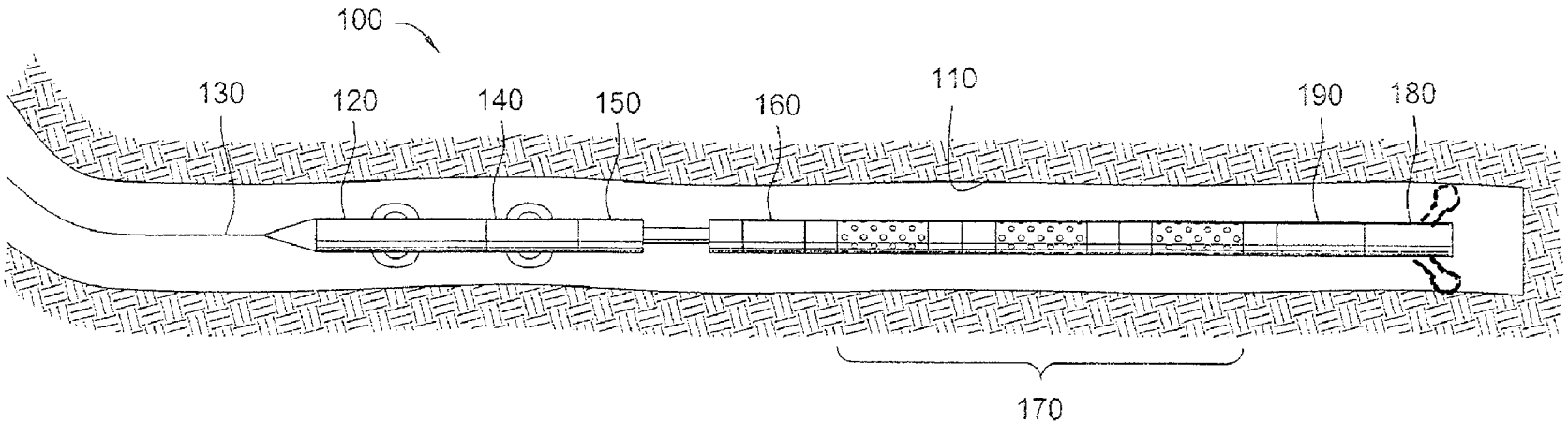
FIG. 1 illustrates a tracking assembly disposed in a horizontal well bore in accordance with implementations of various technologies described herein.

FIG. 1 illustrates a tracking assembly 100 disposed in a horizontal well bore 110 in accordance with implementations of various technologies described herein. The well bore 110 may be cased or lined. Although implementations of various technologies described herein are with reference to a horizontal well bore, it should be understood that these implementations may also be performed in a vertical, slightly deviated or highly deviated well bore. The tracking assembly 100 may include a wireline tractor 120, a wireline 130, a wireline anchor 140, a linear actuator 150 and a running or pulling tool 160. Any type of wireline may be used with the tracking assembly 100. The wireline 130 may be coupled to the wireline tractor 120, which may be configured to grip the well bore 100 and push anything attached thereto inside the well bore 100 and pull the wireline 130 behind it. Although the use of the wireline tractor 120 is described herein with reference to a wireline, it should be understood that in some implementations the wireline tractor 120 may be used autonomously, i.e., without a wireline.

The wireline tractor 120 may be coupled to the wireline anchor 140, which may be configured to anchor the tracking assembly 100 and any tool attached thereto to the well bore 110. The anchor 140 may then be coupled to a linear actuator 150, which may be actuated to couple or uncouple sections of a stackable gun system, which will be described in the paragraphs below. The linear actuator 150 may be coupled to the running or pulling tool 160. Any type of running/pulling tool, such as slickline or coiled tubing tool, may be used with the tracking assembly 100. In one embodiment, actuation of the linear actuator 150 moves the running/pulling tool 160 and any tool attached thereto, without moving the wireline tractor 120 and/or the wireline 130. Also, the linear actuator 150 may be actuated in either direction along a longitudinal axis of the tracking assembly 100.

The running/pulling tool 160 may be coupled to a stackable gun system 170, which may be assembled and disassembled downhole. The stackable gun system 170 may be any type of gun system that may be assembled and disassembled down hole, such as one described in commonly assigned U.S. Pat. No. 6,059,042 entitled COMPLETIONS INSERTION AND RETRIEVAL UNDER PRESSURE (CIRP) APPARATUS INCLUDING THE SNAPLOCK CONNECTOR, which is incorporated herein by reference. The stackable gun system 170 may include a number of perforating guns.

The stackable gun system 170 may be disposed on a downhole platform 180, which may be used to support the guns or gun sections during assembly of the gun sections. The downhole platform 180 may be a mechanically releasable anchor (MRA), a bridge plug, a sump packer and the like. In one implementation, an anchor latch adaptor 190 may be disposed between the stackable gun system 170 and the downhole platform 180. In another implementation, the anchor latch adaptor 190 may be an integral component of the downhole platform 180.

Figure 2:
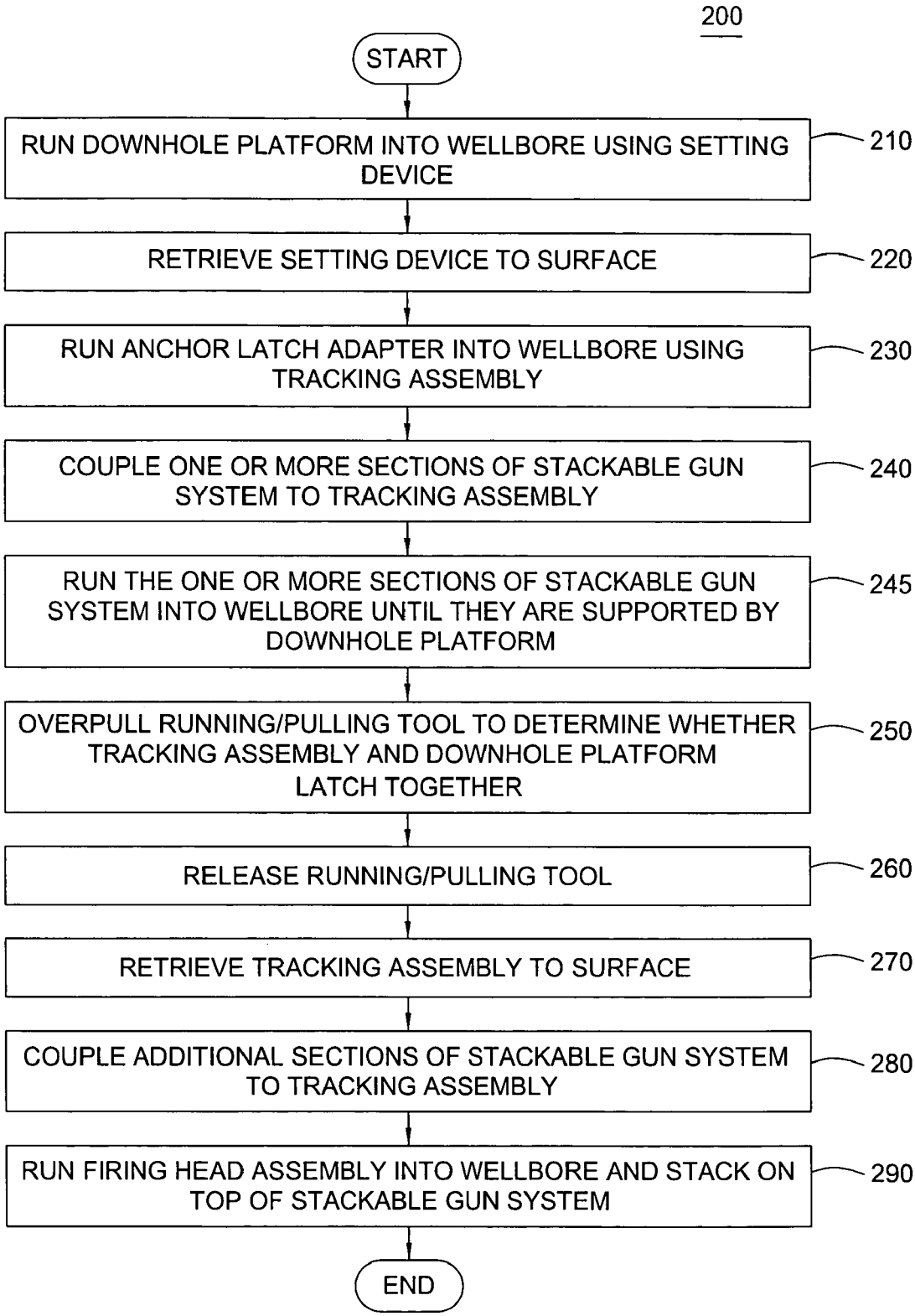
FIG. 2 illustrates a flow diagram of a method for assembling a stackable gun system inside a well bore in accordance with implementations of various technologies described herein.

FIG. 2 illustrates a flow diagram of a method 200 for assembling the stackable gun system 170 inside the well bore 110 in accordance with various implementations described herein. At step 210, the downhole platform 130 may be run into the well bore 110. The downhole platform 180 may be run into the well bore 110 using a setting device, which may be any standard wireline plug/packer setting device, such as the casing packer setting tool (CPST) tool and the like. Once the downhole platform 180 is set in place (shown in FIG. 1 as dashed lines), the setting device may be retrieved to the surface (step 220) by use of the tracking assembly 100. In one implementation, the downhole platform 180 may be positioned in the well bore 110 using a self-releasing positioning tool. At step 230, the anchor latch adaptor 190 may be run into the well bore 110 using the tracking assembly 100 and be set on the downhole platform 180.

In one implementation, the downhole platform 180 and the anchor latch adaptor 190 disposed thereon may be indexed to the well bore 110 by engaging a gyro device with a stackable gun connector therebelow and measuring the relative bearing of the gyro device at the surface. The indexing of the stackable gun connector may then be determined based on the gyro device measurement, thereby enabling the orientation of the stackable gun system 170 with respect to the well bore 110. The gyro device may be deployed and retrieved in and out of the well bore 110 using the tracking assembly 100.

At step 240, one or more sections of the stackable gun system 170 may be coupled to (or rigged up with) the tracking assembly 100. This may be done at the surface At step 245, the one or more sections of the stackable gun system 170 may be run into the well bore 110 using the tracking assembly 100 until the stackable gun section(s) 170 are supported by and/or connected to the downhole platform 180.

In one embodiment, at step 245 the wireline tractor 120 is activated to transport one or more sections of the stackable gun system 170 to a position in proximity to the downhole platform 180; the wireline anchor 140 is then activated to anchor the tracking assembly 100 to the well bore 110; and the linear actuator 150 is activated to apply a linear force to the gun section(s) 170 in the direction of the platform 180 to connect the gun section(s) 170 to the platform 180. Alternatively, the wireline tractor 120 may be used to both transport the gun section(s) 170 and to supply the necessary force to connect the gun section(s) 170 to the platform 180. In one embodiment, the section(s) 170 form a snap fit type of connection both with each other and with the tracking assembly 100 and the platform 180.

At step 250, a slight over pull may be made on the running/pulling tool 160 to determine whether the tracking assembly 100 has successfully connected the gun section(s) 170 with the anchor latch adaptor 190 and/or the downhole platform 180. The over pull may be made by pulling on the wireline 130, such as with a surface winch, or activating the wireline tractor 120 in a direction away from the platform 180.

At step 260, the tracking assembly 100 is disengaged from the gun section(s) 170 by disengaging the wireline anchor 140 from the wellbore 110 and activating the linear actuator 150 in a direction away from the platform 180, or by pulling on the wireline 130, such as with a surface winch. This disengaging step 260 is similar to the over pull step 250 described above, but performed with a larger force, i.e. the force applied at step 260 is sufficient to disengage the tracking assembly 100 from the gun section(s) 170 (i.e. sufficient to overcome the snap fit type connection), while the force applied at step 250 is not sufficient to disengage the tracking assembly 100 from the gun section(s) 170.

At step 270, the tracking assembly 100 may then be retrieved to the surface by activating the wireline tractor 120 in a direction away from the platform 180. At step 280, additional sections of the stackable gun system 170 may be coupled to the tracking assembly 100; run into the well bore 110; and connected to the other sections of the stackable gun system 170 in the same manner as is described above. In one implementation, the gun sections may be latched to each other by the use of connectors, which are described in more detail in commonly assigned U.S. Pat. No. 6,059,042 entitled COMPLETIONS INSERTION AND RETRIEVAL UNDER PRESSURE (CIRP) APPARATUS INCLUDING THE SNAPLOCK CONNECTOR, which is incorporated herein by reference.

One or more sections of the stackable gun system 170 may be retrieved using the tracking assembly 100 at any time during this deployment process. At step 290, a firing head assembly may be run into the well bore 110 and be stacked on top of the stackable gun system 170. The firing head assembly may be any type of firing head assembly that may be used inside a well bore, such as a pressure actuated firing head assembly and the like. The firing head assembly may then be used to fire the stackable gun system 170.

Figure 3:
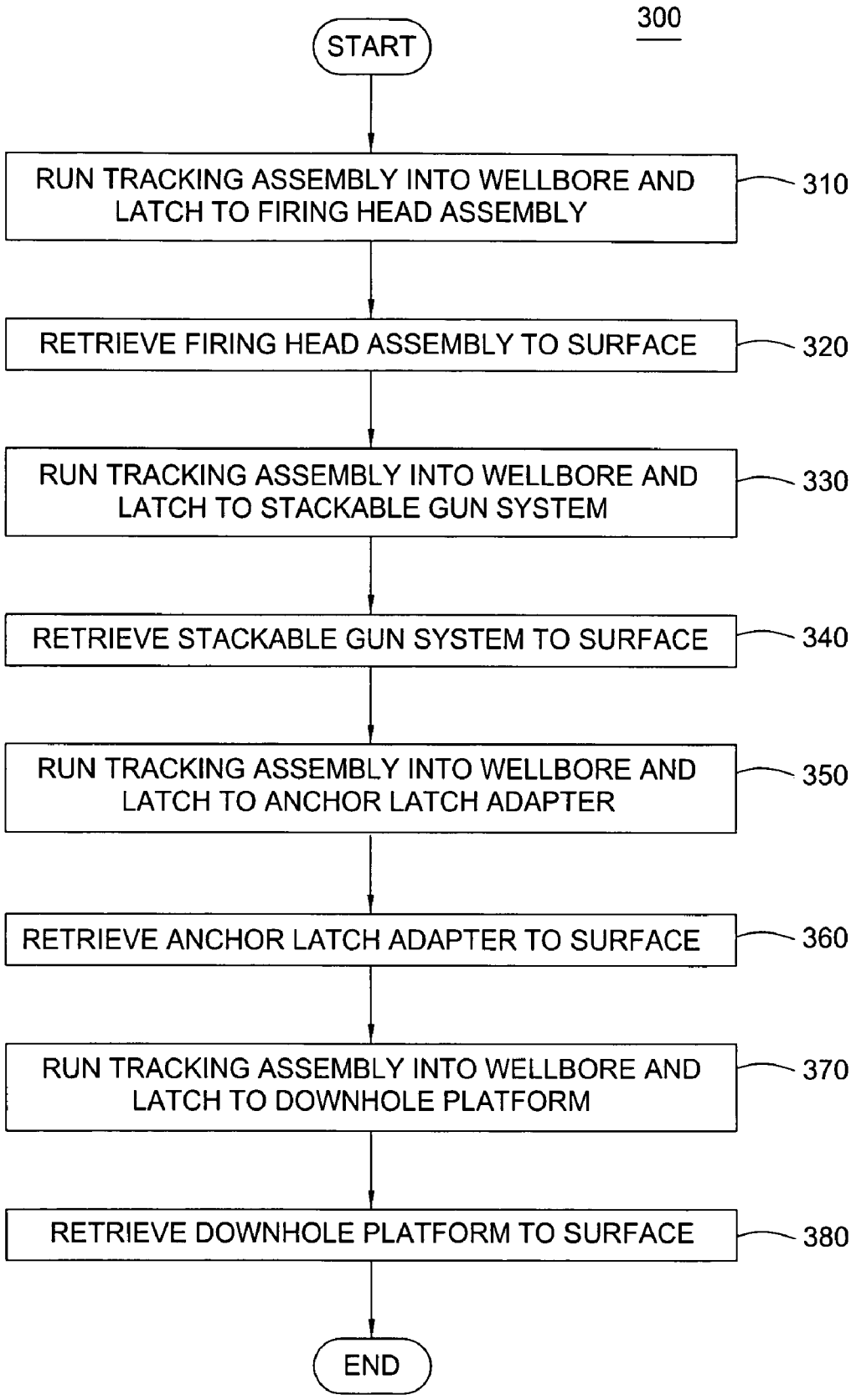
FIG. 3 illustrates a flow diagram of a method for disassembling a stackable gun system inside a well bore in accordance with implementations of various technologies described herein.

FIG. 3 illustrates a flow diagram of a method 300 for disassembling the stackable gun system 170 inside the well bore 110 in accordance with various implementations described herein. The stackable gun system 170 may be disassembled in a manner similar to its assembly inside the well bore 110. In one embodiment, the firing of the firing head causes the gun sections 170 to disengage from each other, the platform 180 and the firing head.

At step 310, the tracking assembly 100 may be run into the well bore 110 and latched to the firing head assembly. At step 320, the firing head assembly may be retrieved to the surface by the tracking assembly 100. In one implementation, the wireline anchor 140 and the linear actuator 150 may each be activated to connect the tracking assembly 100 to the firing head. With the firing head already detached from the gun sections 170, due to the firing of the guns, the firing head may then be retrieved to the surface. At step 330, the tracking assembly 100 may be run into the well bore 110 and latched to the stackable gun system 170. At step 340, the stackable gun assembly 170 may be retrieved to the surface using the tracking assembly 100. In one implementation, the stackable gun system 170 may be retrieved sections at a time.

At step 350, the tracking assembly 100 may be run into the well bore 110 and latched to the anchor latch adaptor 190 and/or the downhole platform 180. At step 360, the anchor latch adaptor 190 may be retrieved to the surface using the tracking assembly 100. At step 370, the tracking assembly 100 may be run into the well bore 110 and latched to the downhole platform 180. At step 380, the downhole platform 180 may be retrieved to the surface using the tracking assembly 100. In one embodiment any or all of steps 330/340, 350/360, 370/380 may be performed as described above from steps 310/320.

Implementations of various technologies described herein are with reference to assembling and disassembling a stackable gun system 170 inside the well bore 110. However, it should be understood that these implementations may also be used to assemble and disassemble other tool strings inside the well bore 110, such as well bore components, intelligent completion components and the like.

While the foregoing is directed to implementations of various technologies, other implementations may be devised without departing from the basic scope thereof, and the scope thereof is determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for assembling a stackable perforating gun system inside a well bore, comprising:

connecting a tracking assembly to a wireline, wherein the tracking assembly comprises a tractor, an anchor and a linear actuator;

attaching a first gun section of the stackable perforating gun system to a tracking assembly, and activating the tracking assembly tractor to transport the first gun section within the well bore;

disengaging the first gun section from the tracking assembly;

retrieving the tracking assembly to the surface;

attaching a second gun section of the stackable perforating gun system to the tracking assembly, and activating the tracking assembly tractor to transport the second gun section within the well bore; and activating the linear actuator to couple the second gun section with the first gun section.

2. The method of claim 1, further comprising anchoring a downhole platform inside the well bore.

3. The method of claim 2, further comprising activating the linear actuator to apply a first linear force on the first gun section, the first linear force being sufficient to couple the first gun section to the downhole platform.

4. The method of claim 3, wherein disengaging the first gun section from the tracking assembly comprises pulling on the wireline to apply a pulling linear force, oppositely directed from the first linear force, on the tracking assembly.

5. The method of claim 3, further comprising pulling on the wireline to apply a second linear force, oppositely directed from the first linear force, on the tracking assembly to determine whether the first gun section has been coupled to the downhole platform.

6. The method of claim 5, wherein disengaging the first gun section from the tracking assembly comprises pulling on the wireline to apply a third linear force, larger than the second linear force and oppositely directed from the first linear force, on the tracking assembly.

7. The method of claim 1, wherein activating the linear actuator to couple the second gun section with the first gun section comprises anchoring the wireline anchor to the well bore, then activating the linear actuator.

8. The method of claim 1, wherein the well bore is a horizontal well bore.

9. The method of claim 1, wherein the well bore is a highly deviated well bore.

* * * * *